United States Patent [19]

Dubiel et al.

[11] Patent Number: 4,524,651

[45] Date of Patent: Jun. 25, 1985

[54] POWER WRENCH

[75] Inventors: Oswald Dubiel; Karl-Richard Hirtsiefer, both of Neunkirchen; Paul-Heinz Wagner, Birrenbachshöhe, D-5203 Much, all of Fed. Rep. of Germany

[73] Assignee: Paul-Heinz Wagner, Much-Birrenbachshohe, Fed. Rep. of Germany

[21] Appl. No.: 363,880

[22] Filed: Mar. 31, 1982

[30] Foreign Application Priority Data

Apr. 3, 1981 [DE] Fed. Rep. of Germany ..... 3113481
Apr. 3, 1981 [DE] Fed. Rep. of Germany ..... 3113482

[51] Int. Cl.[3] ..... B25B 13/46

[52] U.S. Cl. ..... 81/57.39; 81/57.44; 81/52; 173/171

[58] Field of Search ..... 173/12; 81/53 R, 2, 81/57.3, 57.39, 57.44; 408/120

[56] References Cited

U.S. PATENT DOCUMENTS 3,955,447 5/1976 Parker ..... 81/57.39
4,201,099 5/1980 Junkers ..... 81/57.39
4,233,865 11/1980 Junkers ..... 81/57.39

FOREIGN PATENT DOCUMENTS 0035165 2/1981 European Pat. Off. ..... 81/53 R
2358243 3/1978 France ..... 81/57.39
729041 5/1980 U.S.S.R. ..... 81/57.44

*Primary Examiner*—E. R. Kazenske
*Assistant Examiner*—William Fridie, Jr.
*Attorney, Agent, or Firm*—Spensley Horn Jubas & Lubitz

[57] ABSTRACT

A power wrench operated with a pressure medium comprises a wrench head casing (10) which is engaged by a piston-cylinder unit (28,29). The other end of the piston-cylinder unit (28,29) is pressing against a support element (27) guided on a guideway (22) of the wrench head casing (10). The outer end (28) of the support element is applied to a stationary abutment. Upon rotating the wrench head (10) the ring (11) retaining the bolt or screw head is entrained by a ratchet (15) only in one sense of rotation, while the wrench head casing (10) is returned idly without entrainment of ring (11) in the other sense of rotation.

16 Claims, 8 Drawing Figures

POWER WRENCH

Figure 1:
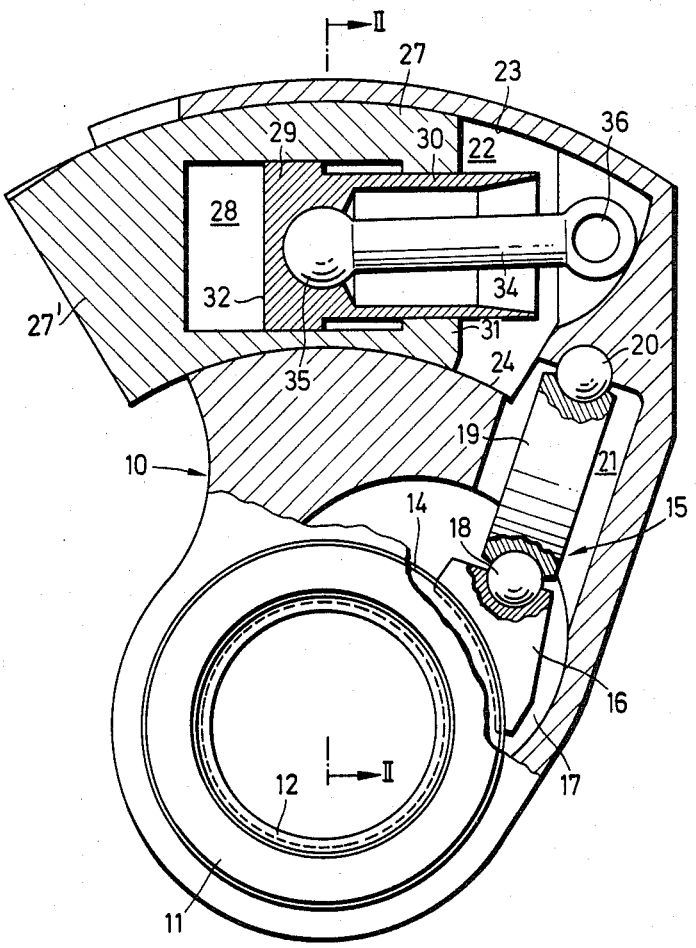

The invention relates to a power wrench comprising 1.1 a wrench head casing having a ring to receive a button die, 1.2 a support element fitted movably at the wrench head casing for an application to a stationary support and 1.3 a piston-cylinder unit acting between the wrench head casing and the support element and moving the wrench head casing relative to the support element.

According to a prior suggestion not belonging to to prior art (patent application P 30 08 332.0-15) the pressure medium cylinder is inside the wrench head casing. The piston movable linearly in the pressure medium cylinder is resting via a piston rod having two flexibly supported ends, on a support element which is seated coaxially to the ring axis at the wrench head. In use, the support element of the power wrench is applied to a stationary abutment and the piston in the pressure medium cylinder moves out. At the same time, the wrench head casing is swivelled relative to the stationarily propped support element about the ring axis. During said swing movement a button die seated inside the ring is entrained by a ratchet thus turning a bolt or screw head introduced into the button die. Upon the return stroke of the piston, the wrench head casing is swivelled into the counter-direction, while the button die is not entrained by the ratchet.

Although the dimensions and the weight of the mentioned power wrench are already much inferior to the customary power wrenches, additional space is required by the support element projecting nearly tangentially to the ring from the wrench head casing. Moreover, the weight of the total power wrench is determined to a great deal by the support element seated at the wrench head.

It is the object of the invention to provide a power wrench of the above mentioned type in which the support element need not be supported at the wrench head casing and which is operative by means of a relatively light-weight support element of a small volume.

It is another object of the invention to provide a power wrench of the above mentioned type in which, in addition to the driving unit another device may also rotate the ring and in which no separate device is required as a return stop for the ring inset.

The problem of the invention is solved in that, with a power wrench of the type set forth above, 1.4 the wrench head casing has a guideway for the support element, 1.5 the support element is displaceable in the guideway and 1.6 the support element freely projects from the one end of the guideway.

As a result, a pivot bearing of the support element at the wrench head casing is unnecessary. The saving in space and weight of the total power wrench as realised by the invention is a particular advantage, indeed.

If the guideway for the support element is straight-lined, its extension should be such that in the central stroke position, the piston-cylinder unit should extend more or less at a right angle to the line passing through the center of the ring and through the piston of the piston-cylinder unit.

It is desirable for power wrenches operated by pressure media to determine the screw moment by which the wrench head acts on the screw head, with the pressure applied to the inside of the cylinder operated by pressure media. It is very easy to measure said pressure. If the relation between the pressure and the screw moment is approximately linear, the screw moment can be determined this way. If the support element engaged by the piston rod rests at the wrench head casing to project therefrom nearly tangentially, the distances between the stationary abutment against which the support element is placed, and the axis of the wrench head casing may often vary. However, with a predetermined pressure in the cylinder, the torque acting on the screw or bolt head is dependent upon the distance between the stationary abutment and the axis of the wrench head casing or upon the length of the moment arm by which the abutment effects the support. A similar dependency upon the length of the support-moment arm does exist if the torque is determined by strain controls at the wrench head casing.

To permit a relatively exact torque determination by measurements of pressure or strain controls, it is provided, according to an advantageous further embodiment of the invention that 2.1 the guideway extends circularly about the axis of the ring.

To this effect, the support element consists of an arc segment which may be moved out of the wrench head casing by means of the piston-cylinder unit and which moves on a circular path about the ring axis.

Due to the circular shape of the support element, the moment arm does not change during the screwing operation because the position of the support element does not change.

On the contrary, the wrench head casing is swivelled to and fro about the ring axis relative to the fixed, stationarily propped support element. In other word, during a piston stroke, the dependency of the screw moment upon the pressure in the cylinder remains linear to a far extent. Thus, it is possible to turn off the screwing device if a specific pressure is attained in the pressure line leading to the cylinder. At the same time, it is ensured, that the screw moment corresponding to said pressure is reached. In general, said linear pressure dependency does not exist in the known power wrenches, because the angle at which the piston cylinder unit engages the wrench head casing varies greatly during a stroke of the known assemblies.

In an advantageous embodiment of the invention, it is provided that 3.1 the cylinder of the piston-cylinder unit consists of a cylindrical, straight-lined cavity inside the support element and 3.2 the piston is hinge-coupled to one end of a rod whose other end is pivoted at the wrench head casing.

Thus, the linear movement of the piston in the cylinder is converted into a circular movement of the support element which, at the same time, forms the cylinder. Alternatively, the support element may be also designed as a piston, while the cylinder is supported at the wrench head casing to freely adjust itself to the corresponding positions of the piston or support element. In any case, the construction and the weight of the power wrench are reduced because either the cylinder or the piston form one piece with or are even designed inside the support element.

A variant of the power wrench of the invention is characterized in that 4.1 the ring is supported in a pivot bearing of the wrench head casing and 4.2 between the wrench head casing and the ring a ratchet is effective entraining the ring only in one sense of rotation of the wrench head casing.

Even in association with power wrenches—such ratchets belong to prior art.

It is not necessary for the power wrench of the invention to include a ratchet, but its design may be such as to perform a manual relocation after each stroke movement of the piston cylinder unit. To this effect, it is provided according to a second variant of the invention that 5.1 the wrench head casing consists of a ring and an extension connectible rigidly with the ring and comprising the guideway, and 5.2 the extension displaceable on a rail extending coaxially to the ring axis of the ring is arrestable in various positions.

Such a power wrench without a ratchet can be produced by being of a still lighter weight and by saving even more space than an apparatus comprising a ratchet. However, when used, it must be taken into account, that after each piston stroke, the ring is to be relocated manually with respect to the wrench head casing, and at least after each second stroke, the total apparatus is to be relocated manually with respect to the element to be rotated.

The invention also relates to a power wrench comprising 1.1 a wrench head casing containing a rotatable ring inset for mounting a button die, 1.2 a drive unit engaging the wrench head casing to move relative to the wrench head casing a support element applicable to a firm abutment, and 1.3 a rotation lock retaining the ring set in the wrench head casing during the tightening movement of the drive unit.

This power wrench is characterized, according to the invention, in that 1.4 the rotation lock consists of a self-locking gear engaging the teeth of the ring element and containing a rotatable drive shaft.

On the one hand, it is the purpose of the self-locking gear of continuously rotating the ring element with a reduced torque, until the bolt head engaged by the ring element offers a greater resistance to the rotation, and, on the other hand, of entraining the ring element with the remaining portion of the wrench head when the drive unit acting between the wrench head and the ring element is operated. In other words, the self-locking gear transmits a drive shaft rotation to the ring element, while it is incapable of transmitting a relative rotation of the ring element within the wrench head casing to the drive shaft. By this means, the drive assembly (acting linearly) combines the functions of a continuous advance movement of the wrench ring in case of a still reduced torque, and of the entrainment of the wrench ring upon a swivel of the wrench head casing. It is not necessary to provide a separate ratchet, thus causing not only a reduction in weight and dimensions of the power wrench, but also permitting a power wrench construction composed of fewer elements.

The self-locking action of the gear is effective in both directions of rotation so that the ring inset is actually entrained by the wrench head casing in both turning directions. If the support element is moved out of the wrench head casing by the drive unit to abut against a fixed stop, the wrench head casing is swivelled while entraining the ring inset and the wrench head. Upon a subsequent turning of the drive shaft of the gear in the same direction as before with an advance at relatively reduced power, the ring inset together with the wrench head remains stationary while the wrench head casing moves again towards the fixed stop, and the support element is returned into the wrench head casing. Now, the next stroke of the drive unit can be performed, and the ring inset is entrained by the wrench head casing in the predetermined direction of rotation of the bolt head. By this means, by alternatingly actuating the drive unit and rotating the drive shaft, the ring inset is turned stepwise resulting also in a stepwise tightening of the bolt or screw head. As a matter of fact, it is also possible, vice versa, to unscrew tight bolt heads by means of the power wrench.

With reference to the drawings, some embodiments of the invention will be explained hereinafter more closely.

Figure 2:
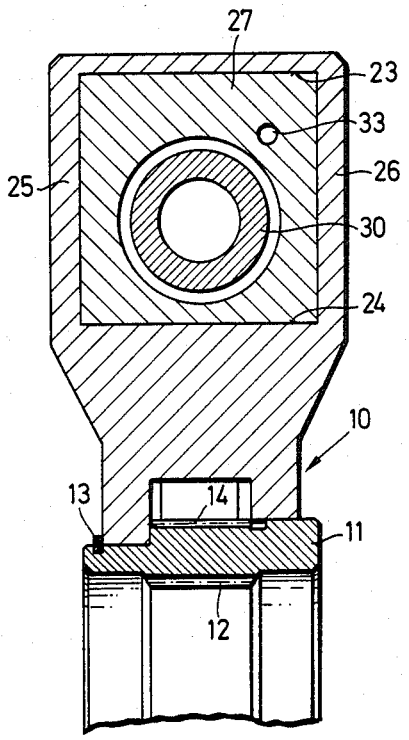
Figure 4:
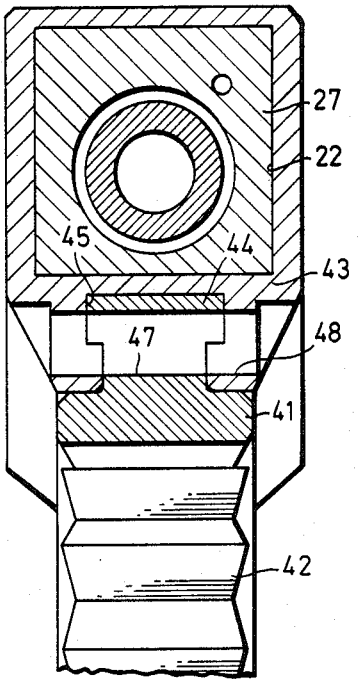
Figure 3:
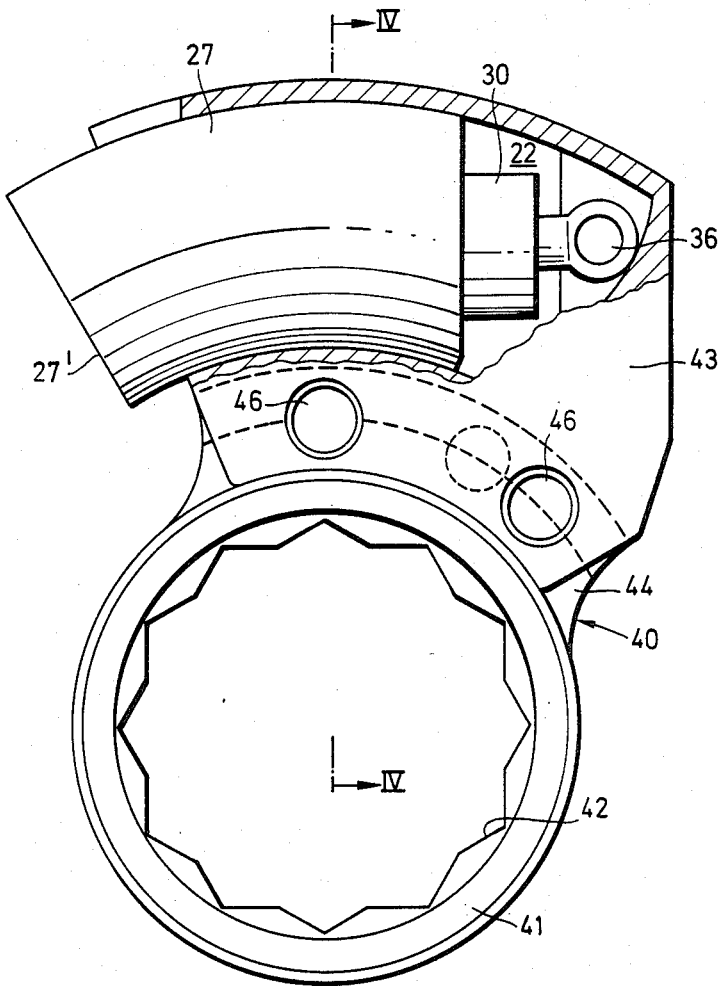
Figure 5:
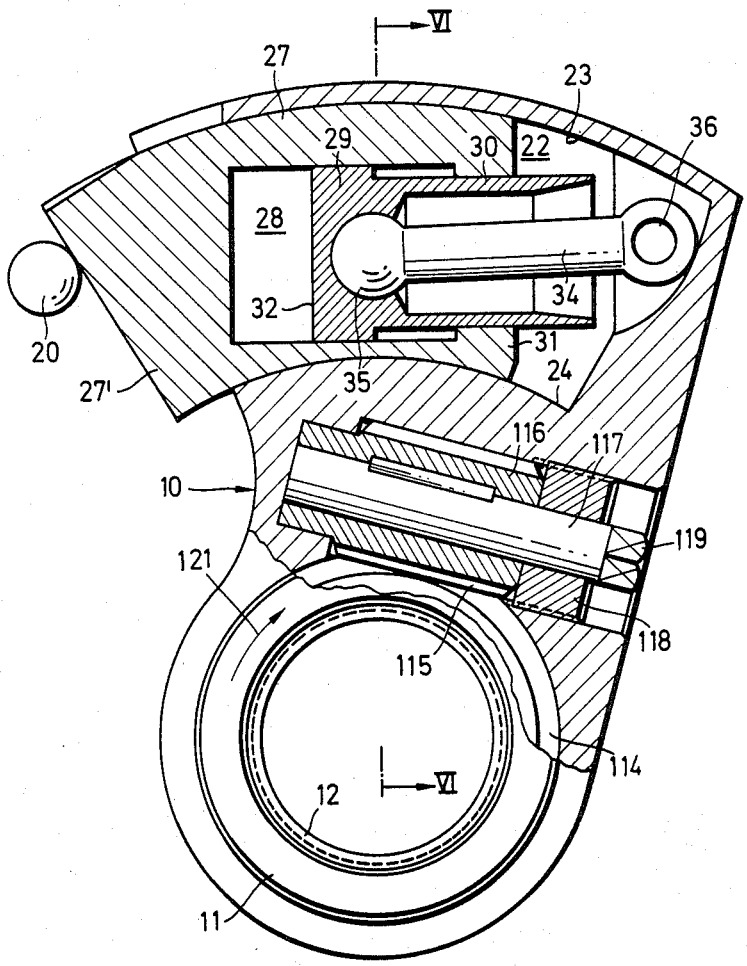
Figure 6:
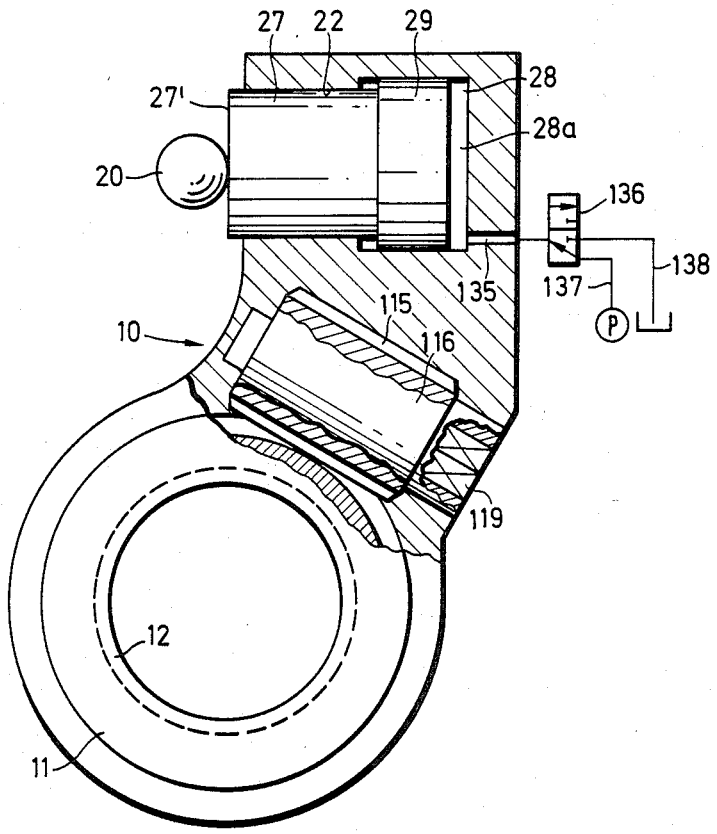
Figure 7:
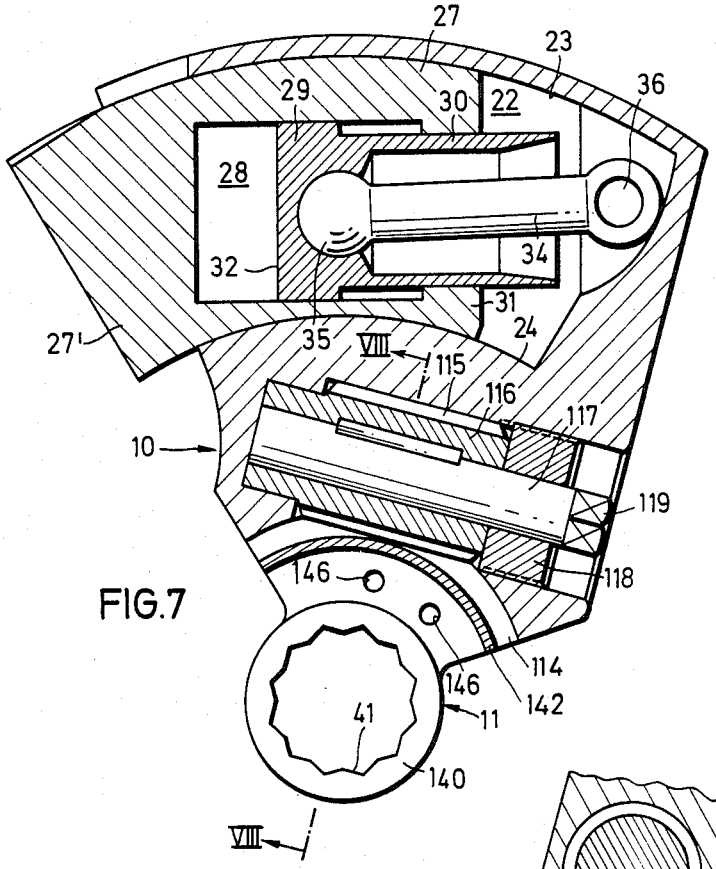
Figure 8:
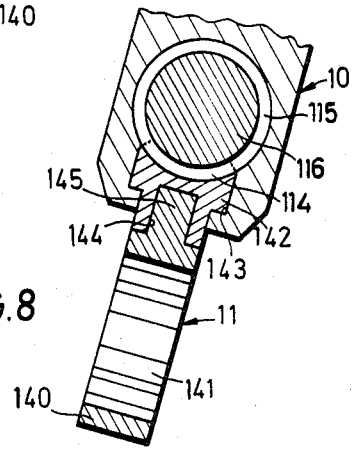

FIG. 1 is a longitudinal section of a first embodiment of the power wrench with ratchet, FIG. 2 is a cross section along line II—II of FIG. 1, FIG. 3 is a partial longitudinal section of a second embodiment of the power wrench without a ratchet, FIG. 4 is a cross section along line IV—IV of FIG. 3, FIG. 5 is a side view of a third embodiment of the power wrench, partially sectional, FIG. 6 is a side view of a fourth embodiment of the power wrench, partially sectional, along line VI—VI of FIG. 5, FIG. 7 is a side view of a fifth embodiment of the power wrench, partially sectional, and FIG. 8 is a section along line VIII—VIII of FIG. 7.

In the embodiment of FIGS. 1 and 2, the power wrench comprises a wrench head casing 10 in which a ring 11 is supported pivotably, the ring being provided with internal teeth 12 between which a button die provided with corresponding external teeth can be inserted axially thus connecting nonrotatably the button die with the ring 11. In the wrench head casing 10 the ring 11 projects slightly to both sides and is anchored by means of a spring ring 13 (FIG. 2) thus being supported undetachably but freely rotatable by the wrench head casing 10. The peripheral wall of the ring 11 is provided with teeth 14 coacting with a ratchet 15 which consists of a toothed segment 16 housed in a cavity 17 of the wrench head casing 10 and meshing with the external teeth 14 of ring 11. The rear side of the toothed segment 16 is provided along an inclined shoulder with a concave recess to receive a ball 18 which, moreover, extends into a concave recess at the end side of a pressure piece 19, the rear end of which is supported with another ball 20 at a wall of the wrench head casing 10, and extends through a bore 21 which is so oriented that the extension of its axis is nearly tangential to ring 11. The diameter of the bore 21 being as great as to permit oscillating movements of the pressure piece 19 within the bore 21, the toothed segment 16 and the outer teeth 14 may demesh. If, however, the wrench head casing 10 is turned clockwise about the axis of ring 11, the pressure piece 19 with the joints formed by the balls 18 and 20 acts as a toggle lever system by which the toothed segment 16 is pressed into the teeth 14. Thus, only a clockwise rotation of the wrench head casing 10 will cause the ratchet 15 to entrain the ring 11.

In addition, the wrench head casing 10 contains a circular segment type guideway 22 curved about the axis of ring 11 and consisting of a cavity having an outer peripheral wall 23 and an inner peripheral wall 24 of a circular extension, while the side walls 25, 26 are plane. As evident from FIG. 2, the cross section of the guideway 22 is rectangular or square. In the circular guideway 22, the support element 27 shaped circularly, as obvious from FIG. 1, has a cross section adapted to the guideway 22. The support element 27 can be displaced along the guideway 22 completely closed peripherally, thus permitting to move its outer end 27' out of the guideway 22 and out of the wrench head casing 10 accordingly. The outer end 27' of the support element 27 is placed against a stationary support, e.g. a wall or an adjacent wrench head to pass off the reaction force formed during screwing.

Inside the support element 27, there is a cylinder chamber 28 in which the piston 29 is displaceable linearly. The center point of the longitudinal axis of the cylinder chamber 28 is nearly vertical to a radius of ring 11 thus allowing to favorably utilize the pressure acting between the piston 29 and the support element 27 to form a torque for the wrench head casing 10.

The rear end of the piston 29 is provided with a tubular extension 30 extending sealingly through the end wall 31 of the cylinder chamber 28. The diameter of the tubular extension 30 is smaller than the front piston surface 32 thus dividing the cylinder chamber 28 into two parts by the piston 29. Each of said parts is connected via a hydraulic line to a (non-illustrated) hydraulic switch valve. The hydraulic lines extend through the support element 27. FIG. 2 shows a hydraulic line 33.

Through the tubular extension 30 and spaced therefrom radially, there extends a piston rod 34 the one end of which is connected to the piston 29 via a spherical joint 35 while its other end is supported via a joint 36 at the wrench head casing 10. With the center position of the piston 29 within the cylinder chamber 28, the piston rod 34 extends nearly coaxially to the axis of the cylinder chamber 28.

By causing a pressure medium to act alternatingly on the region of the cylinder chamber 28 ahead of the piston 29 and on the region downstream of the piston 29, while the support element 27 is stationary, the wrench head casing 10 is pivoted about the axis of ring 11. If the end 28 of the support element 27 is placed against a stationary abutment, a screw head coupled nonrotatably with the ring 11 can be tightened by an alternating to- and fro-movement of the wrench head casing 10, the entrainment of the wrench head by the ratchet 15 being only performed with the advance of the piston (to the right, according to FIG. 1), while, with the return stroke of the piston 29 (from right to left, according to FIG. 1), the ratchet 15 slides idly on the external tooth of ring 11.

In place of the disclosed guideway 22 having a hollow profile closed all over, it is also possible to use an open or partly closed guideway. It is only important that the guidance of the support element 27 along a circular guideway is quite accurate and that its center is at least approximately on the axis of ring 11.

In the embodiment according to FIGS. 3 and 4, there is provided a casing 40 consisting of the extension 43 and of interchangeable ring insets 41. The total ring inset 41 is rigid and has a star-shaped internal contour 42 forming the button die. In a manner, known per se, the internal contour 42 is of such a design that a hexagonal bolt head engaging the button die fits again the button die upon a rotation about 30. In other words, after a rotation angle by 30°, at the earliest, the device can be relocated in its entirety on the bolt head. To reduce as much as possible the change of the torque during the rotation, the rotation angle resulting from the stroke of the piston cylinder unit is limited. To realise for all that the graduation angle of the ring inset 41 or a multiple thereof, the ring inset 41 is connected detachably and pivotably with the attachment 43. To this effect, part of the periphery of the ring inset 41 is provided with a circular guide rail 44 having a T-shaped cross section as evident from FIG. 4. Said T-shaped guide rail 44 is inserted into a T-shaped groove 45 of the attachment 43. Thus, the attachment 43 can be swivelled about the axis of the ring inset 41 on the guide rail 44. The attachment 43 is coupled with the ring inset 41 by means of bolts 46 extending through bores 47, 48 of the guide rail 44 or of the attachment 43. In specific positions of the elements 41 and 43, its bores 47 and 48 are in alignment to permit to pass therethrough a bolt 46.

In case of the internal contour 42 of the button die shown in FIG. 3, a pair of holes consisting of the bores 47 and 48 must be formed at least every 15 degrees of angle in the displacement of the attachment 43 relative to the ring to permit to pass a bolt 46 through the holes.

By this means, in spite of the smaller angle of rotation determined by the piston-cylinder unit, it is possible to realise strokewise the torsion angle of at least 30° required for relocating the device.

To avoid frequent relocating of the attachment 43 at the ring inset 41, an adjustable extension, e.g. a strong screw, may be provided at the outer end 27' of the support element 27. After having been moved out, the support element 27 can be returned again as a whole or in part. Then, the adjustable extension is secured to the end 27' of the support element 27 which is moved out again. In place of an adjustable extension, it is possible to temporarily fit an interchangeable intermediate piece at the end 27' of the support element 27. Thus, a saving of stroke is possible by simple means.

In the embodiment of FIG. 5, the power wrench contains a wrench head casing 10 in which a ring inset 11 is pivoted. The ring inset 11 is provided with internal teeth 12, into which a button die provided with corresponding external teeth can be inserted axially thus connecting nonrotatably the button die with the ring 11. In the wrench head casing 10, the ring inset 11 projects slightly to both sides and is anchored by means of a (non-illustrated) spring ring thus being supported undetachably but freely rotatably by the wrench head casing 10. The peripheral wall of the ring inset 11 is provided with a worm toothing 114 meshing with the worm toothing 115 of a worm 116 connected nonrotatably with the drive shaft 117 supported bilaterally in a recess of the wrench head casing 10. The bearing is formed by a plug 118 screwed into a thread bore of the wrench head casing 10. The outer end of the drive shaft 117 extending through the plug 118 carries a square 119 permitting to fit from the outside a tool to turn the drive shaft 117 and the worm 116 accordingly. Upon rotation of the latter, the ring inset 11 pivoted in the wrench head casing 10 is driven.

Besides, the wrench head casing 10 is designed as that shown in FIG. 1. A (non-illustrated) button die is introduced into the internal teeth 12 of the ring inset 11 to tighten a screw or bolt head. Thereafter, the wrench head casing 10 is so rotated that the projecting front end 27' of the support element 27 abuts against a stationary stop 20 serving as a support during the screwing operation. By adapting a manual or mechanical turning tool to the square 119, the drive shaft 117 with the worm 116 is so rotated that the ring inset 11 within the wrench head casing 10 is rotated in direction of the arrow 121. Thus, the bolt head first rotatable without great energy consumption, is tightened. Should the screw head cause a greater rotational resistance, the wrench head casing 10 moves in anticlockwise direction from the position shown in FIG. 5, thus drawing the support element 27 into the guideway 22, while the front face 32 of the piston 29 is pressed against the front end wall of the cylinder chamber 28.

If, due to the excessive screw moment, no rotation of the ring inset 11 by the worm 116 is possible any longer, pressure is fed into the part of the cylinder chamber 28 ahead of the piston 29 thus pressing to the right the piston 29 in the cylinder chamber, as shown in FIG. 5. The support element 27 resting against the stop 20, the wrench head casing 10 is rotated clockwise. At that moment, the ring inset 11 and the bolt head are entrained. Upon reaching the end of the piston stroke, the drive shaft 117 is again rotated to turn the ring inset 11 relative to the wrench head casing 10 in direction of the arrow 121. In reality, the ring inset 11 together with the bolt head remains in fixed condition, while the wrench head casing 10 is turned in anticlockwise direction. As a result, the part of the cylinder chamber 28 being ahead of the piston 29 is reduced, thus expelling the pressure medium out of the cylinder chamber. As a matter of fact, only the front side 32 of the piston 29 is under the action of the pressure medium, but not its rear side.

In the embodiment of FIG. 6 the elements corresponding to or performing the same function as the embodiment of FIG. 1 or 5 are marked with the same reference numerals. The differences only are explained hereinafter.

According to FIG. 6 the piston is movable in a cylinder bore 28 of the wrench head casing 10. The piston 29 is firmly connected to the support element 27 which is straight-lined and displaceable within the straight-lined guideway 22, it being possible to place its front end 27' against a stationary stop 20.

A line 135 extends into the portion **28*a* of the cylinder chamber 28 turned away from the support element 27, which line can be connected alternatingly via a switch valve 136 either to a pressure line 137 or to a return line 139 extending into a reservoir. Preferably the switch valve 138 is electromagnetic and actuated by (non-illustrated) limit switches which define the position of the piston 29 at the corresponding ends of the cylinder chamber 28. If, as shown in FIG. 6, the piston 29 has moved out to the left the support element 27 while the end of the piston path of the piston is reached, line 135 is connected to the return line 138 via the switch valve 136. Now, by rotating the worm wheel 115 at the square 119, the wrench head casing 10 can be swivelled back anticlockwise, while the piston 29 is retained by the stop via the support element 27. As a result, portion 28*a* of the cylinder chamber 28 is reduced, while the pressure medium is pressed into the return line 138. The reaching of the rear final position of the piston 29 is detected by the corresponding limit switch indexing now the switch valve 136 into the (illustrated) position in which the line 135 is connected to the pressure line 137**. A new piston stroke can be effected now.

As obvious, the pressure on part **28*a* of the cylinder chamber 28 is applied automatically subject to the corresponding end position of the piston 29. Therefore, the operator only needs to rotate the recessed square 119 or the drive shaft of the worm 116 at his choice to ensure that the support element 27 always remains at the stop 20**. The piston strokes are controlled automatically.

The embodiment of FIGS. 7 and 8 corresponds to a far extent to that of FIG. 5, thus requiring only an explanation of the differences as set forth hereinafter. The ring inset 11 contains a ring element 140 designed as a button die and enclosing a recess 141 having a multiple hexagonal profile. The hexagonal head of a screw to be turned can be introduced into the recess 141. The ring inset 11 is then connected nonrotatably with the screw or bolt head. Unlike the embodiment of FIG. 5, the ring inset 11 is not surrounded through 360° by teeth, but it only contains a toothed segment 142 extending about the ring element 140 at an angle of nearly 90°. The toothing 114 at the toothed segment 142 extends coaxially to the ring element 140 and meshes with the worm pivoted in the remaining portion of the wrench head casing 10.

As evident from FIG. 8, the toothed segment 142 has a T-shaped cross section and is guided in a T-shaped groove 143 of the wrench head casing adapted to said cross section. The groove 143 is circular and extends coaxially to said ring element 140.

The toothed segment 142 is detachably connected to the ring element 140. To this effect, the inside of the toothed segment 142 is provided with a circular groove 144 into which projects a circular, radial attachment 145 of the ring element 140. The lateral boundary walls of the groove 144 and of the attachment 145 contain bores 146 which may be caused to be in registry by rotating the ring element 140. A (non-illustrated) pin can be passed through the aligned bores to lock the ring element 140 with the toothed segment 142.

To use the device according to FIGS. 7 and 8, action is taken as set forth in FIG. 5 in that, alternatingly, the drive shaft 17 is rotated and pressure is applied to the cylinder chamber 28. If the end of the toothed segment 142 meshes with the worm 116, the total device is removed, if necessary, from the bolt head to be returned by means of shaft 117 into the starting position. Due to the detachable connection by means of groove 144, attachment 145 and (non-illustrated) plugs, it is possible to couple with the toothed segment 142 ring elements 140 of different sizes.

What is claimed is:

1. A power wrench comprising:

a wrench head casing having a ring to receive a button die;

a support element carried within the wrench head casing for abutment against a stationary support;

a piston-cylinder unit coupled between the wrench head casing and the support element for moving the wrench head casing relative to the support element; and a guideway for the support element contained in said wrench head casing, said piston-cylinder unit located in said guideway and said support element being displaceable in the guideway and freely protruding from one end of the guideway.

2. A power wrench according to claim 1 wherein the guideway extends substantially circularly about the axis of the ring.

3. A power wrench according to claim 1 wherein:

the cylinder of the piston-cylinder-unit consists of a cylindrical cavity inside the support element; and the piston is hinge-coupled to one end of a piston rod whose other end is pivoted at the wrench head casing.

4. A power wrench according to claim 1 further comprising:

a pivot bearing in the wrench head casing for supporting the ring; and a ratchet between the wrench head casing and the ring effective for entraining the ring so that the wrench head casing rotates in one direction but not the other.

5. A power wrench according to claim 1 wherein the wrench head casing has an extension which comprises the guideway, said extension being displaceable on a rail which extends coaxially to the ring axis of the ring, said extension being rigidly connectable to said rail at various positions.

6. A power wrench comprising:

a ring to receive a socket for application to a head of a bolt or the like to be turned;

a wrench body connected to said ring having a guideway extending nonradially with respect to said ring and located in a plane parallel to said ring;

a support element coupled to and movable relative to said body within said guideway and placeable at a first side of said support element against a stationary abutment; and a driving means for moving said support element relative to said body within said guideway, wherein said driving means comprises a piston-cylinder unit having a first end coupled to said support element at a second side of said support element opposite said first side and a second end opposite said first end coupled to said wrench body.

7. A power wrench as in claim 6 wherein said guideway is arcuate and centered about the axis of said ring.

8. A power wrench as in claim 7 in which said driving means comprises a piston-cylinder unit having a first end coupled to said support element at a second side of said support element opposite said first side and a second end opposite said first end coupled to said wrench body.

9. A power wrench as in claim 8 wherein said piston-cylinder unit comprises:

a cylinder chamber located in said support element at said second side;

a piston displaceable linearly within said chamber; and a piston rod coupled to said body on one piston rod end and said piston on the other piston rod end.

10. A power wrench as in claim 9 wherein said cylindrical chamber is sealed on each side of said piston and said piston is displaced linearly within said chamber by establishing different pressures on the two sides of said piston.

11. A power wrench as in claim 6 wherein said piston-cylinder unit includes a cylindrical chamber formed in the support element in a region adjacent said guideway on the second side of said support element opposite said first side and a piston located and linearly displaceable within said chamber.

12. A power wrench as in claim 6 wherein said ring has gear teeth on its periphery and further comprising a ratchet mechanism on said body having a toothed section for engagement with said gear teeth, whereby said head is turned only when said driving means moves said support element relative to said wrench body in one direction within said guideway.

13. A power wrench as in claim 6 wherein said ring has a guide rail along at least a part of its periphery and said wrench body has a groove for insertion therein of said guide rail, said guide rail being movable within said groove so that said wrench body is rotatable relative to said ring about the ring axis and further comprising means for detachably connecting said ring and said wrench body at various relative rotations of wrench body and ring.

14. A power wrench as in claim 6 wherein said ring has teeth on its outer periphery and said wrench body has a worm with threads mounted therein for meshing with said teeth on said ring, whereby said wrench body is rotated relative to said ring by turning said worm.

15. A power wrench as in claims 9 or 10 wherein said cylindrical chamber is located so that the longitudinal axis of said cylindrical chamber is tangential to a circle centered on the axis of the ring at a point approximately at the center of said longitudinal axis.

16. A power wrench comprising:

a ring adapted to receive a tool for application to a component to be turned;

a wrench body connected in rotational force transmitting relationship to said ring, said body having a guideway therein;

a support element mounted partially within said guideway and movable relative to said body, a portion of said support element projecting from said guideway being placeable against a stationary abutment; and a driving means, situated within said guideway, for moving said support element while said projecting portion is emplaced against said abutment, the resultant movement of said body imparting rotational force to said ring, thereby turning said tool and component, wherein said driving means comprises a piston-cylinder unit having a first end coupled to said support element at a second side of said support element opposite said first side and a second end opposite said first end coupled to said wrench body.

* * * * *